US008040260B2

(12) United States Patent
Mohaupt et al.

(10) Patent No.: US 8,040,260 B2
(45) Date of Patent: Oct. 18, 2011

(54) SYSTEM AND METHOD OF DISPLAYING TRAFFIC INFORMATION ON A DISPLAY DEVICE USING A GRAPHICAL ELEMENT TO INDICATE A CATEGORY OF THE TRAFFIC INFORMATION

(75) Inventors: Skady Mohaupt, Stuttgart (DE); Timo Peichl, Stuttgart (DE)

(73) Assignee: Alpine Electronics, Inc., Tokyo (JP)

( * ) Notice: Subject to any disclaimer, the term of this patent is extended or adjusted under 35 U.S.C. 154(b) by 498 days.

(21) Appl. No.: 12/268,673

(22) Filed: Nov. 11, 2008

(65) Prior Publication Data

US 2009/0140889 A1 Jun. 4, 2009

(30) Foreign Application Priority Data

Dec. 3, 2007 (EP) ..... 07023357

(51) Int. Cl.
*G08B 21/00* (2006.01)

(52) U.S. Cl. ..... 340/995.13; 340/995.27; 701/208; 701/210

(58) Field of Classification Search ..... 340/990, 340/995.26, 995.27, 905, 995.13; 701/200, 701/201, 206–211, 117–119
See application file for complete search history.

(56) References Cited

U.S. PATENT DOCUMENTS 7,099,773 B2 8/2006 Linn

FOREIGN PATENT DOCUMENTS

| | | |
|---|---|---|
| EP | 1150264 | 10/2001 |
| EP | 1150449 | 10/2001 |
| EP | 1538582 | 6/2005 |

*Primary Examiner* — Jeffery Hofsass
(74) *Attorney, Agent, or Firm* — Brinks Hofer Gilson & Lione

(57) ABSTRACT

A traffic information display system comprises a traffic information processing unit adapted to receive traffic information data which are transmitted in multiple cycles and to generate at least one portion of traffic information from the traffic information data which is indicative of a traffic event, and a display unit coupled with the traffic information processing unit and which is adapted to display the at least one portion of traffic information. The display unit includes a user receiving status determining unit which is adapted for assigning a category of a plurality of categories to the at least one portion of traffic information, the plurality of categories being indicative of different user receiving statuses of traffic information. The display unit is adapted for displaying at least one graphical element which is associated with the at least one portion of traffic information, wherein the at least one graphical element is indicative of the assigned category of the at least one portion of traffic information. Accordingly, the system may reduce driver distraction when searching for interesting traffic messages.

20 Claims, 3 Drawing Sheets

SYSTEM AND METHOD OF DISPLAYING TRAFFIC INFORMATION ON A DISPLAY DEVICE USING A GRAPHICAL ELEMENT TO INDICATE A CATEGORY OF THE TRAFFIC INFORMATION

FIELD OF THE INVENTION

The present application claims priority to European Patent Application Number 07023357.2, filed Dec. 3, 2007, the entirety of which is hereby incorporated by reference.

The present invention is directed to a traffic information display system comprising a traffic information processing unit adapted to receive traffic information data which are transmitted in multiple cycles and to generate at least one portion of traffic information from the traffic information data which is indicative of a traffic event, and further comprising a displaying unit coupled with the traffic information processing unit and which is adapted to display the at least one portion of traffic information. The invention is further directed to a method of displaying traffic information on a display device, comprising the steps of receiving traffic information data which are transmitted in multiple cycles and generating at least one portion of traffic information which is indicative of a traffic event from the traffic information data.

DESCRIPTION OF THE RELATED ART

Traffic information display systems are known in various different configurations. Particularly, traffic information display systems are known to be part of a navigation device such as an on-vehicle navigation device used for guiding a driver of the vehicle. For example, a typical on-vehicle navigation device may include a head unit comprising a display system which is placed in front of or in the vicinity of a driver's seat, for example in the mid console of the interior car environment. Such a display system commonly includes a display device including a display screen which may be used, for instance, in connection with such a vehicle navigation system for displaying a map image, and also for displaying information in connection with the guidance function of the navigation device.

Generally, a traffic information display system may implement a technology such as the Traffic Message Channel (TMC) technology or the Traffic Protocol Experts Group (TPEG) technology. The TMC-technology is an analog technology for delivering traffic and travel information to drivers, such as a driver of a vehicle, whereas the TPEG-technology is a digital technology used for such purposes and making use of DVB-T or DAB receivers, for example. In the following, particularly referring to the TMC-technology, the individual TMC messages are transmitted repeatedly in multiple cycles transmitting the traffic data in temporal loops over the multiple cycles. For example, one cycle includes multiple messages related to different traffic events, wherein the time period for one cycle may be, for example, one to several minutes. In this way, within one cycle multiple portions of traffic information for various streets and/or locations is transmitted in a coded manner, wherein the data for each of the streets or locations are repeatedly transmitted and updated at times over the multiple cycles. Therefore, the driver of a vehicle is continually provided with traffic information from an external traffic information provider, wherein the traffic messages are received, for example, from a satellite used by the traffic information provider.

In EP 1 150449 A1 there is disclosed a method and apparatus for reducing data communication in an RDS TMC message environment. Particularly, a cycle of messages is processed, wherein each message is consecutively repeated several times. First a message is received and checked for correctness. Next, the correct message is forwarded for further processing, wherein after the checking the most recent message is compared with its direct predecessor and upon correspondence therebetween, the predecessor is forwarded accompanied by a validation signal when detecting that the predecessor was the first correct message. In this way, a short-time discarding mechanism at an early stage of the RDS TMC processing is achieved, so that messages may be discarded immediately without even considering the relevance of their information content.

In U.S. Pat. No. 7,099,773 B2 there is disclosed a method for a navigation system which modifies a route to the destination by allowing a user to select types of items or conditions to be avoided on the route. The method includes the steps of displaying a set of data indicating items that a user will encounter when the user follows the calculated route, prompting the user to select a type of item to be avoided on a new route to the destination, and recalculating the new route according to the user's selection and guiding the user to the destination through the new route. The navigation system displays the set of items which is classified into distance ranges each representing a range of distance from a current user position where each item is represented by a corresponding icon. In this way, the user can see the different types of traffic incidents by icons or symbols. A color coding shows the seriousness of the traffic events.

Typically, traffic events in a navigation system are arranged and displayed in a list having a predefined order, wherein the different entries of such list are sorted, for example, by street names or numbers. For instance, U.S. Pat. No. 7,099,773 B2 shows in FIG. 4A an example of such a list. Particularly in the case that such a list is rather long, the driver has a very high mental work load during driving when trying to recognize the respective traffic event he or she is interested in. A further disadvantage of such a traffic event list is that the driver often cannot remember if he or she has already read a specific traffic message, so that the driver each time must go through the whole list searching for the respective traffic event he or she is interested in. An overall effect thereof may be that driver distraction during driving is increased.

SUMMARY OF THE INVENTION

It is therefore an object of the present invention to provide a traffic information display system that may contribute to decreasing driver distraction during driving. It is a further object of the invention to provide a corresponding method of displaying traffic information on a display device.

displayAccording to one embodiment of the invention, a traffic information display system comprises a traffic information processing unit adapted to receive traffic information data which are transmitted in multiple cycles and to generate at least one portion of S traffic information from the traffic information data which is indicative of a traffic event, and a displaying unit coupled with the traffic information processing unit and which is adapted to display the at least one portion of traffic information. The displaying unit includes a user receiving status determining unit which is adapted for assigning a category of a plurality of categories to the at least one portion of traffic information, wherein the plurality of categories is indicative of different user receiving statuses of traffic information. The display unit is adapted for displaying at least one graphical element which is associated with the at least one portion of traffic information, wherein the at least one graphical element is indicative of the assigned category of the at least one portion of traffic information.

According to one method of displaying traffic information on a display device according to the invention, the method comprises the acts of: receiving traffic information data which are transmitted in multiple cycles and generating at least one portion of traffic information which is indicative of a traffic event from the traffic information data, displaying the at least one portion of traffic information on a display device, assigning a category of a plurality of categories to the at least one portion of traffic information, wherein the plurality of categories is indicative of different user receiving statuses of traffic information, and displaying at least one graphical element which is associated with the at least one portion of traffic information, wherein the at least one graphical element is indicative of the assigned category of the at least one portion of traffic information.

For example, the plurality of categories may be indicative of different user reading statuses of traffic information. With assigning of a category of the plurality of categories it may be indicated to the user whether the at least one portion of traffic information has already been read by the user, or not. Further, it may be indicated to the user whether the at least one portion of traffic information has already been read by the user, but the at least one portion of traffic information is an updated version of an earlier portion of traffic information transmitted in an earlier cycle. Therefore, the user may easily distinguish, by means of the graphical element which is indicative of the assigned category, whether the at least one portion of traffic information reflects a new traffic event, or a traffic event already read by the user, or a traffic event already read by the user but updated by the traffic message provider. In this way, the traffic information display system shows the status of the traffic event, particularly the user receiving status which indicates whether the user has already received, for example has already read, the corresponding portion of traffic information related to that traffic event. In this way, the user, for example a driver of a vehicle, may easily distinguish between new (and usually more important) traffic messages and earlier traffic messages which have already been read by the driver or which have been updated by the traffic information provider.

According to an embodiment of the invention, the plurality of categories comprises at least three categories including a first category being indicative of a first user receiving status which indicates that the at least one portion of traffic information has not been received by the user, a second category being indicative of a second user receiving status which indicates that the at least one portion of traffic information has already been received by the user, and a third category being indicative of a third user receiving status which indicates that an earlier portion of traffic information associated with the at least one portion of traffic information had been received by the user, but the at least one portion of traffic information is an updated version of the earlier portion of traffic information.

According to another embodiment of the invention, the at least one graphical element which is indicative of the assigned category of a respective portion of traffic information may be implemented in different ways.

According to a first embodiment, the display unit is adapted for displaying at least one portion of an image in a specific color as the at least one graphical element, wherein the specific color is indicative of the assigned category of the at least one portion of traffic information. In other words, the at least one graphical element is implemented as a specific color which is indicative of the assigned category. For example, for three different categories three different colors may be used as respective graphical elements.

According to another embodiment, the display unit is adapted for displaying at least one graphical symbol or icon as the at least one graphical element, wherein the graphical symbol or icon is indicative of the assigned category of the at least one portion of traffic information.

By using different colors and/or different graphical symbols or icons, the respective assigned category of the corresponding portion of traffic information may easily be recognized by the driver of a vehicle. For example, the color red may be used for indicating any newly received traffic events, so that the driver can see at one glance whether the respective portion of traffic information is new, and thus may be important for the driver, or is representing traffic information which has already been read by the driver.

According to a further embodiment of the invention, the traffic information processing unit is adapted to generate from the traffic information data multiple portions of traffic information, wherein each portion of traffic information is indicative of a respective traffic event, the display unit being adapted to display the multiple portions of traffic information. The user receiving status determining unit is adapted for assigning a respective category of the plurality of categories to each of the multiple portions of traffic information. The display unit is adapted for displaying the multiple portions of traffic information in a respective entry of a list, wherein the display unit displays at least one respective graphical element associated with each entry of the list, the graphical element associated with a respective entry being indicative of the assigned category of the portion of traffic information of the respective entry. In this way, by displaying respective graphical elements associated with a respective entry in a list of traffic information, even in relatively large lists the user may easily recognize which of the entries represent traffic information which is new and important to the driver.

According to another embodiment of the invention, the display unit is adapted to display a map together with the at least one portion of traffic information, wherein the at least one portion of traffic information is displayed in visual association with a corresponding geographical location on the map. The display unit is further adapted for displaying the at least one graphical element in visual association with the at least one portion of traffic information. For example, a portion of traffic information which indicates a traffic jam on a street displayed on the map is displayed in visual association with the corresponding geographical location (i.e. street) of the traffic jam on the map, wherein the graphical element is also displayed in visual association with the corresponding portion of traffic information. For instance, the respective traffic jam may be indicated on the map with the color red used as graphical element associated with the portion of traffic information related to that traffic jam, which indicates to the driver that the information related to that traffic jam is new and has not yet been received by the driver.

Further advantageous features and embodiments of the invention are evident from the following claims.

The traffic information display system and method for displaying traffic information on a display device may be used, in principle, with any kind of technology for delivery traffic and travel information to users, such as drivers of a vehicle. For example, the traffic information display system and corresponding method according to the invention may be implemented in a system using the TMC technology or TPEG technology, as referred to above, or so-called Car2-Car (Car-to-car) traffic information messages. Further, the invention may be used in connection with any type of traffic information system which is used for displaying traffic and travel information of any kind to users of such a system. In a particular embodiment, the traffic information display system may be implemented in a navigation system which uses the display of geographical information for guiding the user from one location to another. In such a navigation system, a function may be implemented which displays traffic information to the user in the form of a list of traffic events and/or by displaying traffic events at a corresponding location on a map displayed on a display device.

BRIEF DESCRIPTION OF THE DRAWINGS

The invention will now be explained in more detail by means of embodiments taken in conjunction with accompanying drawings, in which.

DETAILED DESCRIPTION OF THE EMBODIMENTS

Figure 1:
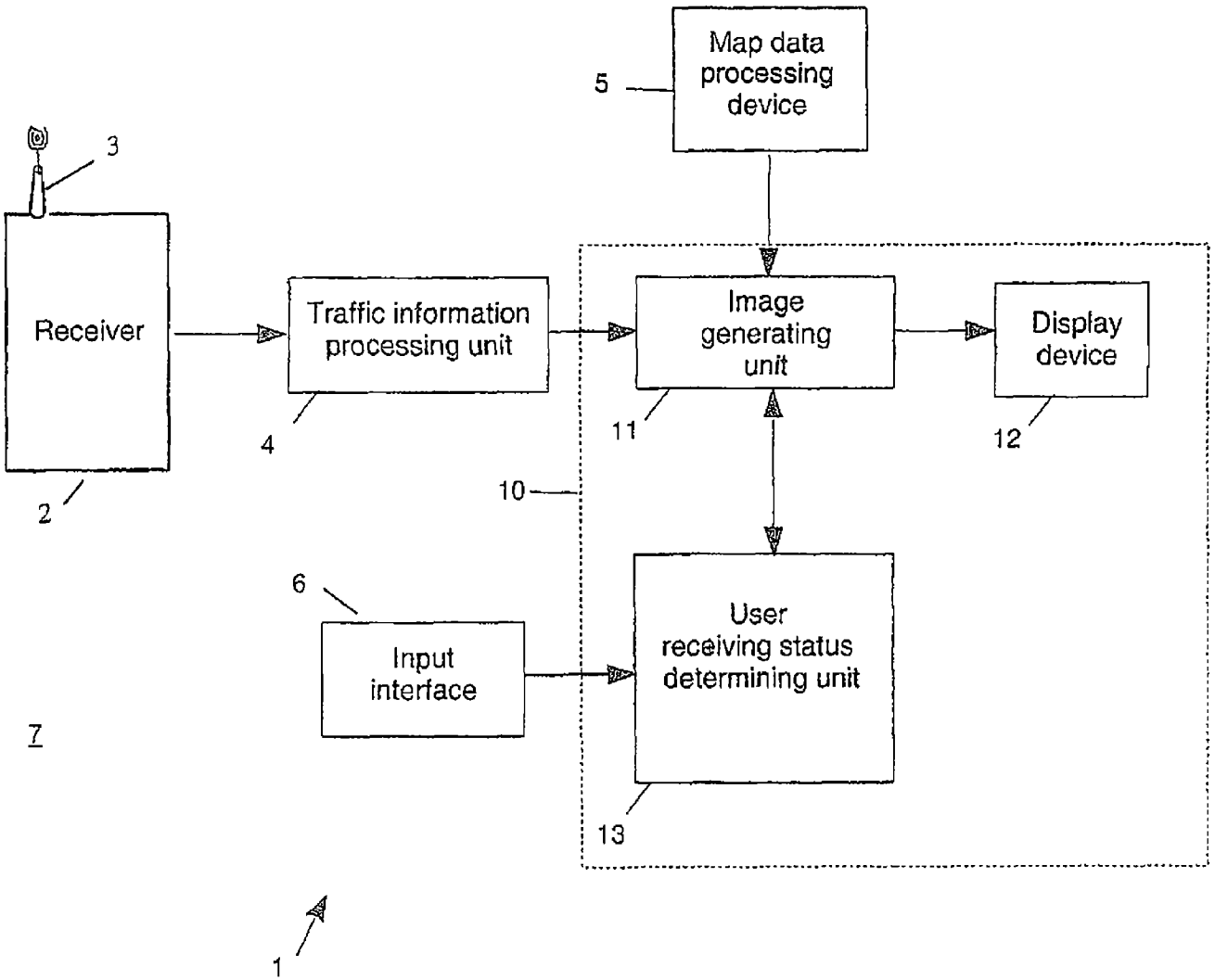
FIG. 1 shows a schematic block diagram of a traffic information display system configured according to an embodiment of the invention.

In FIG. 1 there is shown a schematic block diagram of a traffic information display system configured according to an embodiment of the invention. The traffic information display system 1 as shown in FIG. 1 may be part of a navigation system 7, such as a navigation system implemented on a vehicle. For reasons of brevity, components of the navigation system which are not directly related to the processing and displaying of traffic information are not shown in FIG. 1. For example, the navigation system may include, as further components, a storage device such as a DVD reader and corresponding memory for reading map data from a storage medium for displaying on a display device, and may also include a vehicle position detector for detecting a vehicle's current position on the displayed map. Further, such system may include a known central processing unit (CPU), ROM and RAM memory and a communication bus for interconnecting such components with each other.

Now turning in more detail to FIG. 1, the traffic information display system 1 according to an embodiment of the present invention comprises a receiver 2 for receiving traffic information data via an antenna 3, which data may be, for instance, coded traffic information data provided from an external traffic information provider which may use, for example, a satellite for transmitting the traffic information. For example, the system 1 is implemented in a vehicle, wherein the receiver 2 is capable of receiving data provided from the satellite via the antenna 3. In this context, any other signal transmission technology may be used, such as signal transmission using mobile phone technology or a technology used in broadcasting. The receiver 2 is coupled with a traffic information processing unit 4 via a data transmission path which may be a communication bus of a vehicle. The traffic information processing unit 4 may be a subunit of a navigation system, particularly a subunit for processing coded traffic information received from the receiver 2. In case that the received data are analog traffic messages, the traffic information processing unit 4 may be implemented as a TMC module, or any other module appropriate for receiving and processing such traffic messages. In a system 1 according to FIG. 1, traffic messages may operate not only to inform the driver, but also to provide dynamic navigation by consideration of the current traffic situation during computation of the travel route in the navigation system. For example, the navigation system may provide suggestions such as how to avoid a traffic jam.

Typically, the traffic information data received by the receiver 2 are repeatedly transmitted by the traffic information provider in multiple cycles, wherein each cycle comprises multiple data packets of different content, so that data related to a particular traffic event are transmitted in temporal loops over the multiple cycles. From one loop to another, the traffic information provider may update a respective portion of traffic information related to a traffic event which has changed, for example when the length of a traffic jam has increased or decreased. For instance, changed traffic messages may occur over rather great time periods, depending on the traffic information provider, so that the time period between a new traffic message and an updated version thereof may be rather long.

The traffic information processing unit 4 is coupled with a display unit 10. Particularly, the display unit 10 includes an image generating unit 11 which is coupled with a display device 12, such as a display screen, which may be used to display various portions of traffic information to the driver of a vehicle. The image generating unit 11 is further coupled with a map data processing device 5 which receives corresponding map data (not shown) from a DVD storage medium or the like and which serves to transmit corresponding signals to the image generating unit 11 for displaying a map on the display device 12.

The display device 12 may be a display screen, a touch screen or any other type of suitable display device. According to another embodiment, the display device 12 may be a head up display device.

The display unit 10 according to the invention comprises a user receiving status determining unit 13 which is adapted for assigning a category of a plurality of categories to at least one portion of traffic information, as explained in more detail below. To this end, the user receiving status determining unit 13 of the embodiment according to FIG. 1 is coupled with an input interface 6, which may be an input interface of any known type for receiving a user's instructions or feedback with respect to particular information displayed on display device 12. For example, the input interface 6 may incorporate one or more knobs, or may incorporate a keypad or the like. In the case that the display device 12 is implemented as a touch screen, the input interface 6 may be part of the display device 12, so that the user may enter his or her instructions to the system by touching a corresponding area on the display device 12.

In the present embodiment, when traffic information is displayed on the display device 12, the input interface 6 may be used by a user to communicate to the user receiving status determining unit 13 that portions of the traffic information displayed on the display device 12 have been read by the user. For example, the user may press on a corresponding button displayed on the display device 12 indicating to the user receiving status determining unit 13 that the user has received, i.e. in the present example has read, corresponding portion(s) of traffic information. According to another embodiment, if the traffic information is transmitted to the user by voice mail, or, more generally by acoustic signals, the user may indicate to the user receiving status determining unit 13 when he or she has received, i.e. has heard and recognized, corresponding portion(s) of traffic information which has (have) been acoustically transmitted by a loudspeaker. In this way, the user receiving status determining unit 13 may determine whether the user has received a corresponding portion of traffic information, so that the system assumes that the user has recognized the corresponding portion of traffic information.

For example, the user receiving status determining unit 13 comprises a storage device which stores a plurality of categories related to the user receiving status of traffic information. For example, the plurality of categories may include at least two categories, one of which indicating that the user has received, i.e. read or heard, a respective portion of traffic information, and another category indicating that the user has not received, i.e. has not read or heard, the corresponding portion of traffic information. Each time the user receives a respective portion of traffic information, the user preferably operates the input interface 6, for example by pressing a button or the like, indicating to the system that he or she has received the corresponding portion(s) of traffic information.

Figure 2:
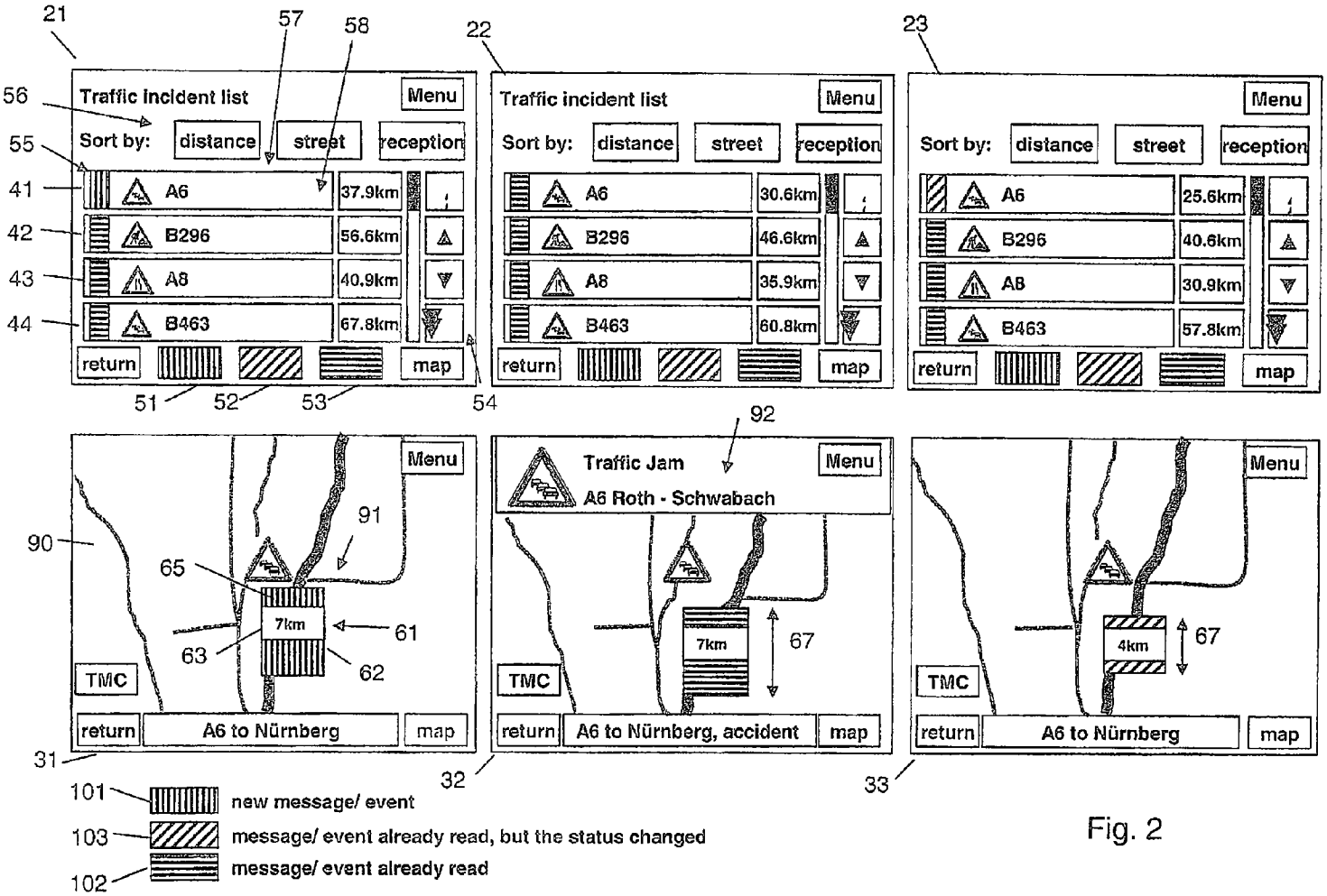
FIG. 2 shows exemplary screen outputs on a display device used in connection with a traffic information display system according to an embodiment of the invention.

Now referring to FIG. 2, there are shown various embodiments of screen outputs on the display device 12.

As shown at the bottom of FIG. 2, the user receiving status determining unit 13 may include a table of a plurality of categories comprising, in the present embodiment, at least three categories 101 to 103. A first category 101 is indicative of a first user receiving status which indicates that a corresponding portion of traffic information has not been received by the user, i.e. represents a new traffic message. A second category 102 is indicative of a second user receiving status which indicates that a corresponding portion of a traffic information has already been received by the user, i.e. represents an "old" traffic message. A third category 103 is indicative of a third user receiving status which indicates that an earlier portion of traffic information associated with a currently displayed portion of traffic information had been received by the user, but the corresponding currently displayed portion of traffic information is an updated version of the earlier portion of traffic information.

The traffic information display system 1 as shown in FIG. 1 may generate images 21 to 23 on the display device 12, as shown in the upper row of FIG. 2. The traffic information processing unit 4 according to FIG. 1 generates from the traffic information data multiple portions of traffic information 41 to 44, wherein each portion of traffic information is indicative of a respective traffic event. The multiple portions of traffic information 41 to 44 are each displayed in a respective entry 58 of a list 57 displayed on the display device 12. For example, the different entries 58 of the different portions of traffic information 41 to 44 are related to traffic jams occurring at different streets designated as A6, 8296, A8 and 8463 with "A" designating an "Autobahn" and "8" designating a "Bundesstrasse". On the right column of each entry 58, the respective distance to the traffic jam is shown to the driver, for example the distance to the traffic jam on the Autobahn A6 is 37.9 km. At the outermost right portion of image 21, the user may select various arrow-buttons 54 for scrolling in the list 57. With the "return"-button, the user may switch to a previous screen image, and with the "map"-button, the user may switch to a map display, such as shown in images 31 to 33 in the lower row of FIG. 2. With the buttons 56, the user may sort the list 57 according to distance of the traffic jam, according to street order, or according to a reception time of the corresponding portion of traffic information.

In each of the entries 58 of the list 57 there is shown a respective graphical element associated with each entry 58 of the list, wherein the graphical element associated with a respective entry is indicative of the assigned category of the portion of traffic information of the respective entry 58. For example, with respect to the portion of traffic information 41 related to "A6", there is displayed a graphical element 55 associated with the entry 58 which includes the portion of traffic information 41. In the present embodiment, the graphical element 55 includes a rectangular field displayed in a specific color which is representative of the category 101 which indicates to the driver that a new message/event is displayed the portion of traffic information 41. For example, the color of graphical element 55 is red, so that the driver may recognize at one glance when looking at the list 57 that the portion of traffic information 41 has newly arrived and has not yet been recognized by the driver. On the other hand, the portions of traffic information 42 to 44 are designated by a graphical element 55 in a different color representing category 102, for example in the color blue. At the bottom of image 21, the respective categories are displayed to the driver in respective buttons 51 to 53 used for filtering the information.

The graphical elements 55 for the portions of traffic information 41 to 44 are designated in the user receiving status determining unit 13 which assigns one of the categories 101 to 103 to each of the portions 41 to 44, so that the image generating unit 11 may generate a corresponding color in the respective entry 58.

As shown in image 22 of FIG. 2, the user has indicated to the user receiving status determining unit 13 that he or she has read the portion of traffic information 41 by pressing a corresponding button on an input interface or by pressing on the respective message when using a touch screen, so that the graphical element 55 may change to be now indicative of the category 102 which indicates that the portion of traffic information 41 has been ready by the driver. Accordingly, the image 22 shows a list 57 of traffic messages which have all been read by the driver, thus showing graphical elements 55 in the color blue, for example.

Referring to image 23 in FIG. 2, it is assumed that an updated traffic message has been received for "A6" (e.g. the length of the traffic jam has changed) so that the graphical element 55 changes its color to show the status 103 which indicates that an earlier portion of traffic information associated with the portion of traffic information 41 shown in image 23 had been received by the user (as explained with reference to image 22 of FIG. 2), but the displayed portion of traffic information 41 on the current image 23 is an updated version of the earlier portion of traffic information. Accordingly, the graphical element 55 is displayed in the color yellow, for example, representing that user receiving status. Again when the user indicates to the system that he or she has read portion of traffic information 41, the graphical element 55 will change from yellow to blue.

In the lower row of FIG. 2, an embodiment is shown according to which the display unit 10 according to FIG. 1 shows a map 90 together with at least one portion of traffic information 61 being displayed in visual association with a corresponding geographical location 91 on the map 90. For example, the geographical location 91 on the map 90 is a geographical location of the traffic event. In the present example, it is assumed that on the street "A6" a traffic jam occurs at geographical location 91 having the length of 7 km. The corresponding portion of traffic information 61 is displayed in a designated area 62 on the map, which designated area 62 also includes at least one graphical element 65 similar to the graphical element 55 as explained with reference to images 21 to 23.

Again, it is assumed that graphical element 65 has an initial color of red, that is, the corresponding portion of traffic information 61 has not yet been read by the driver. The driver may open, by pressing the TMC-button, a TMC list and may press on the respective traffic event button. The driver then sees details of the event in a corresponding area 92, as shown in image 32, wherein the graphical element 65 still has the color coding of red. In the field 63 of the designated area 62, the user is informed of the length of the traffic jam. After this, when returning back to the navigation map display shown in image 32, the color of graphical element 65 turns to blue. The color stays blue until a TMC message change is received. Then, as shown in image 33, the color of graphical element 65 turns yellow, thus indicating status 103.

In the embodiment of FIG. 2, the geometric dimension 67 of the designated area 62 of the portion of traffic information 61 changes upon a change of the content of the portion of traffic information 61, when the corresponding content is updated from one cycle to another cycle. In the present case, the length 67 of rectangular area 62 of portion of traffic information 61 changes instantly, i.e. in the present case reduces as the length of the traffic jam changes from 7 km to 4 km.

With the buttons 56 displayed in the upper part of the images 21 to 23, the presently used input interface making use of a touch screen may receive a user's instructions as to filtering the multiple portions of traffic information 41 to 44 according to different criteria. For example, the user may filter the portions of traffic information 41 to 44 and/or may sort the traffic information according to distance, street and/or reception time. According to another embodiment, the input interface may also be adapted for receiving a user's instructions as to filtering the multiple portions of traffic information 41 to 44 according to the assigned category 101 to 103, e.g. by means of buttons 51 to 53, for example displaying messages with category 101 (new message/event) on top of the list and displaying messages with category 103 (message/event already read, but /21 status changed to an updated status) at a position following a message with category 101. Messages with category 102 are shown at the bottom of the list.

Figure 3:
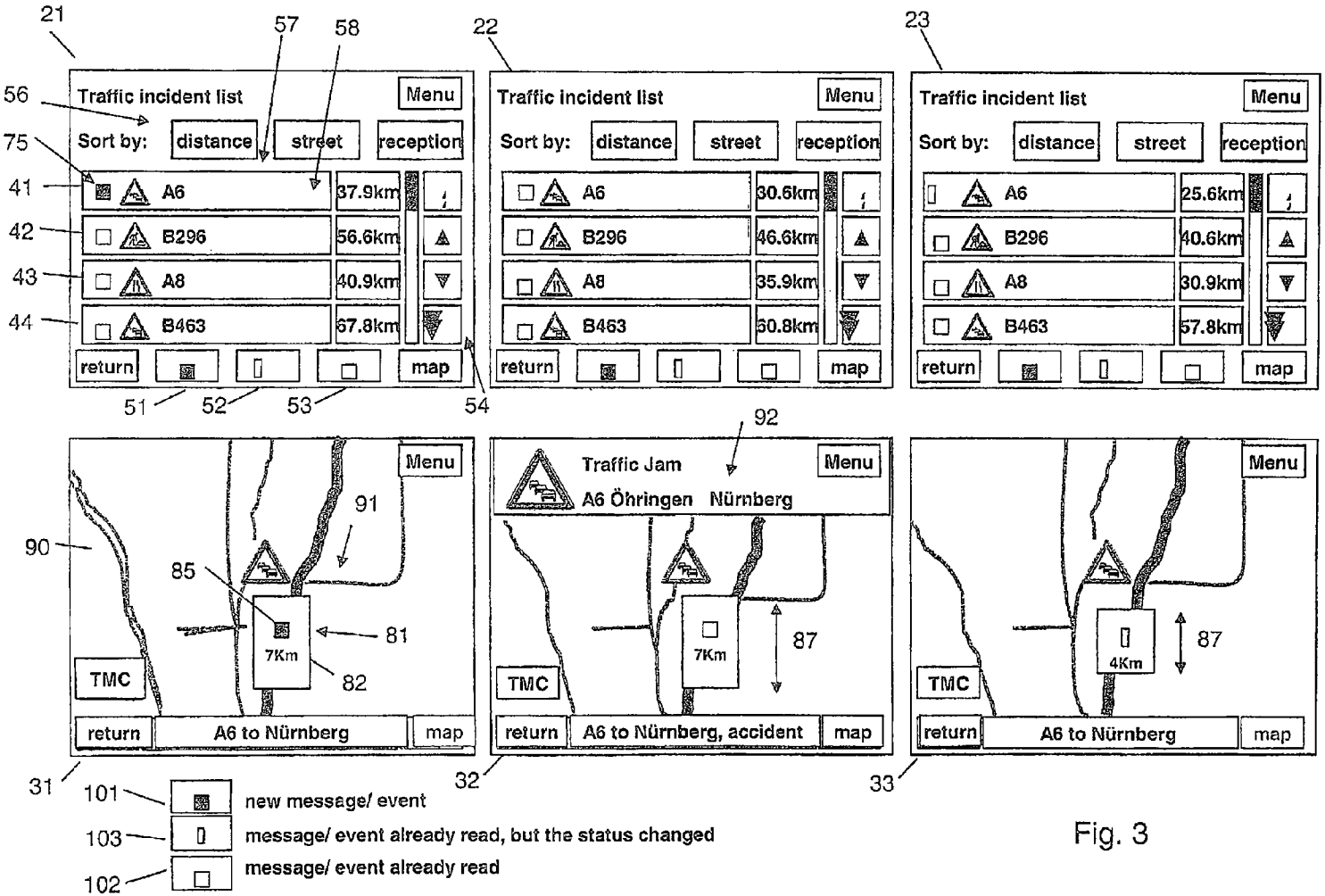
FIG. 3 shows exemplary screen outputs on a display device according to another embodiment of the invention.

Now referring to FIG. 3, there are shown other embodiments of screen outs puts showing images 21 to 23 and 31 to 33 which are similar to images 21 to 23 and 31 to 33 as shown in FIG. 2. However, the embodiments of FIGS. 2 and 3 differ as to the particular implementation of the graphical element.

According to FIG. 3, the graphical element 75 displayed in each entry 58 of the list 57 is implemented as representing a graphical symbol or icon, wherein the respective graphical symbol or icon is indicative of the assigned category of the plurality of categories 101 to 103. As shown at the bottom of FIG. 3, each of the categories 101 to 103 has a different symbol or icon which are a significant indication to the user which of the categories is assigned to a respective portion of traffic information. Again, it is assumed that the portion of traffic information 41 is representing a new message/traffic event, indicated by a graphical symbol or icon as shown with respect to category 101. If the driver has read the corresponding message, the graphical element 75 changes to a symbol or icon as shown in image 22 of FIG. 3 indicating category 102. Image 23 of FIG. 3 shows the status in which portion of traffic information 41 is updated and has not yet been read by the driver, so that the graphical element 75 indicates category 103.

The lower row of FIG. 3 showing images 31 to 33 corresponds to the lower row of FIG. 2 according to which a portion of traffic information 81 is shown together with a map 90, wherein the portion of traffic information 81 is displayed in visual association with the corresponding geographical location 91 of the traffic event. The graphical element 85 is indicating the symbol or icon associated with categories 101 to 103. Again, the geometric dimension 87 of the designated area 82 showing the portion of traffic information 81 may change upon a change of the traffic event from one transmission cycle to another transmission cycle, as shown in images 32 and 33 of FIG. 3.

Therefore, the system according to the invention can use different ways of indicating of the user receiving status of traffic information, such as color coding or using different icons or symbols. Further, different sorting variants may be used so that the newest messages may be provided at the top of a list, and the oldest messages may be provided at the bottom of the list, or a corresponding receiving time may be indicated on the map. The advantageous effects of the invention are that the driver may be less distracted when searching for information on a traffic information display system, due to the reduced search time, particularly when new messages with a corresponding graphical element are displayed at the top of the list. Moreover, the driver may be less confused, due to the clear messages indicating which of the messages have already been read and can be skipped for reading. The use of graphical symbols and icons as the graphical element, instead of color coding or the like, has the advantage that monochrome monitors may be used instead of a color monitor which would be required in the case of color coding. Moreover, any other suitable methods of coding are, in principle, applicable which are capable of indicating an assigned category. Optionally, the user can filter the traffic messages according to their status so that only new and updated messages may be displayed, thus reducing the amount of information provided to the user.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

The invention claimed is:

1. A traffic information display system comprising:

a traffic information processing unit adapted to receive traffic information data which are transmitted in multiple cycles and to generate at least one portion of traffic information from the traffic information data which is indicative of a traffic event, and a display unit coupled with the traffic information processing unit and which is adapted to display the at least one portion of traffic information, the display unit including a user receiving status determining unit which is adapted for assigning a category of a plurality of categories to the at least one portion of traffic information, the plurality of categories being indicative of different user receiving statuses of traffic information, wherein the display unit is adapted for displaying at least one graphical element which is associated with the at least one portion of traffic information, wherein the at least one graphical element is indicative of the assigned category of the at least one portion of traffic information.

2. The traffic information display system according to claim 1, wherein:

the user receiving status determining unit is adapted for assigning the category of a plurality of categories comprising at least three categories including:

a first category being indicative of a first user receiving status which indicates that the at least one portion of traffic information has not been received by the user, a second category being indicative of a second user receiving status which indicates that the at least one portion of traffic information has already been received by the user, and a third category being indicative of a third user receiving status which indicates that an earlier portion of traffic information associated with the at least one portion of traffic information had been received by the user, but the at least one portion of traffic information is an updated version of the earlier portion of traffic information.

3. The traffic information display system according to claim 1, wherein the display unit is adapted for displaying at least one portion of an image in a specific color as the at least one graphical element, wherein the specific color is indicative of the assigned category of the at least one portion of traffic information.

4. The traffic information display system according to claim 1, wherein the display unit is adapted for displaying at least one graphical symbol or icon as the at least one graphical element, wherein the graphical symbol or icon is indicative of the assigned category of the at least one portion of traffic information.

5. The traffic information display system according to claim 1, wherein:

the traffic information processing unit is adapted to generate from the traffic information data multiple portions of traffic information, wherein each portion of traffic information is indicative of a respective traffic event, the display unit is adapted to display the multiple portions of traffic information, and the user receiving status determining unit is adapted for assigning a respective category of the plurality of categories to each of the multiple portions of traffic information, wherein the display unit is adapted for displaying the multiple portions of traffic information in a respective entry of a list, wherein the display unit displays at least one respective graphical element associated with each entry of the list, the graphical element associated with a respective entry being indicative of the assigned category of the portion of traffic information of the respective entry.

6. The traffic information display system according to claim 1, wherein:

the display unit is adapted to display a map together with the at least one portion of traffic information, the at least one portion of traffic information being displayed in visual association with a corresponding geographical location on the map, wherein the display unit is adapted for displaying the at least one graphical element in visual association with the at least one portion of traffic information.

7. The traffic information display system according to claim 6, wherein the display unit is adapted for displaying the at least one portion of traffic information and the at least one graphical element in a designated area on the map.

8. The traffic information display system according to claim 7, wherein at least one geometric dimension of the designated area changes upon a change of the content of the at least one portion of traffic information from one cycle to another cycle.

9. The traffic information display system according to claim 7, wherein the geographical location on the map is indicating a geographical location of the traffic event.

10. The traffic information display system according to claim 1, wherein the display unit comprises a touch screen, and the display unit displays the at least one portion of traffic information in such a way that upon touching the at least one portion of traffic information by the user on the touch screen further information regarding the respective traffic event is displayed.

11. The traffic information display system according to claim 1, further including:

an input interface coupled with the display unit, wherein:

the traffic information processing unit is adapted to generate from the traffic information data multiple portions of traffic information, wherein each portion is indicative of a respective traffic event, and the input interface is adapted for receiving a user's instructions as to filtering the multiple portions of traffic information.

12. The traffic information display system according to claim 11, wherein:

the user receiving status determining unit is adapted for assigning a respective category of the plurality of categories to each of the multiple portions of traffic information, and the input interface is adapted for receiving a user's instructions as to filtering the multiple portions of traffic information according to the assigned category.

13. A navigation system including a traffic information display system according to claim 1.

14. A method of displaying traffic information on a display device, comprising:

receiving traffic information data which are transmitted in multiple cycles and generating at least one portion of traffic information which is indicative of a traffic event from the traffic information data, displaying the at least one portion of traffic information on a display device, assigning a category of a plurality of categories to the at least one portion of traffic information, the plurality of categories being indicative of different user receiving statuses of traffic information, and displaying at least one graphical element which is associated with the at least one portion of traffic information, wherein the at least one graphical element is indicative of the assigned category of the at least one portion of traffic information.

15. The traffic information display method according to claim 14, wherein the plurality of categories comprises at least three categories including:

a first category being indicative of a first user receiving status which indicates that the at least one portion of traffic information has not been received by the user, a second category being indicative of a second user receiving status which indicates that the at least one portion of traffic information has already been received by the user, and a third category being indicative of a third user receiving status which indicates that an earlier portion of traffic information associated with the at least one portion of traffic information had been received by the user, but the at least one portion of traffic information is an updated version of the earlier portion of traffic information.

16. The traffic information display method according to claim 14, wherein the at least one graphical element comprises at least one graphical symbol or icon indicative of the assigned category of the at least one portion of traffic information.

17. The traffic information display method according to claim 14, wherein:

the traffic information generating act is adapted to generate from the traffic information data multiple portions of traffic information, wherein each portion of traffic information is indicative of a respective traffic event, the displaying act is adapted to display the multiple portions of traffic information, and the assigning act is adapted for assigning a respective category of the plurality of categories to each of the multiple portions of traffic information, wherein the displaying act is adapted for displaying the multiple portions of traffic information in a respective entry of a list and displaying at least one respective graphical element associated with each entry of the list, the graphical element associated with a respective entry being indicative of the assigned category of the portion of traffic information of the respective entry.

18. The traffic information display method according to claim 14, wherein:

the displaying act is adapted to display a map together with the at least one portion of traffic information, the at least one portion of traffic information being displayed in visual association with a corresponding geographical location on the map, wherein the displaying act is adapted for displaying the at least one graphical element in visual association with the at least one portion of traffic information.

19. The traffic information display method according to claim 14, wherein the displaying act comprises providing a touch screen, and the at least one portion of traffic information is displayed in such a way that upon touching the at least one portion of traffic information by the user on the touch screen, further information regarding the respective traffic event is displayed.

20. The traffic information display method according to claim 14, wherein:

the traffic information generating act is adapted to generate from the traffic information data multiple portions of traffic information, wherein each portion is indicative of a respective traffic event, and the method receives a user's instructions as to filtering the multiple portions of traffic information.

* * * * *